United States Patent [19]

Odawara

[11] Patent Number: 4,941,314

[45] Date of Patent: Jul. 17, 1990

[54] APPARATUS FOR TREATING TAIL YARN IN TEXTILE SPINDLE ASSEMBLY

[75] Inventor: Kunimitsu Odawara, Hiroshima, Japan

[73] Assignee: Odaware Industry Co., Ltd., Hiroshima, Japan

[21] Appl. No.: 394,577

[22] Filed: Aug. 16, 1989

[30] Foreign Application Priority Data

Aug. 31, 1988 [JP] Japan ..... 63-113492

[51] Int. Cl.[5] ..... D01H 1/38

[52] U.S. Cl. ..... 57/299; 57/278; 57/303

[58] Field of Search ..... 57/299, 303, 306, 276, 57/278; 242/18 PW, 18 EW

[56] References Cited

U.S. PATENT DOCUMENTS

| | | | |
|---|---|---|---|
| 3,768,242 | 10/1973 | Angst et al. | 57/303 |
| 3,967,440 | 7/1976 | Narumi et al. | 57/303 |
| 4,050,227 | 9/1977 | Berend | 57/303 |
| 4,617,791 | 10/1986 | Lousberg | 57/299 |
| 4,796,422 | 1/1989 | Odawara | 57/299 |

*Primary Examiner*—John Petrakes

*Attorney, Agent, or Firm*—Burgess, Ryan & Wayne

[57] ABSTRACT

Disclosed is an apparatus for treating tail yarns in textile spindle assemblies of textile spinning machines, twisters, etc., wherein a stationary upper slit ring and an axially slidable cylindrical member having a lower slit ring at an upper end thereof and a lower portion outwardly expandable by centrifugal force and provided with a spring are mounted on a base portion of a spindle to form a tail yarn gripping means, the pressed state of which is released by sliding the cylindrical member downward by rotational centrifugal force, whereby the yarn underwindings can be automatically removed from the tail yarn gripping means during operation.

Further, not only the elasticity of the cylindrical member itself but also the force of the spring is utilized for restoring the lower portion of the cylindrical member from the expanded state to the initial state, and hence the lower portion of the cylindrical member is surely positively restored to the initial state, whereby the tail yarn is surely firmly fixed to the tail yarn gripping means.

4 Claims, 6 Drawing Sheets

APPARATUS FOR TREATING TAIL YARN IN TEXTILE SPINDLE ASSEMBLY

BACKGROUND OF THE INVENTION

This invention relates to an apparatus for treating tail yarns in textile spindle assemblies of textile spinning machines, twisters or the like, more particularly to the improvement of an apparatus for holding and automatically releasing tail yarns, for example, separated ends of yarns wound on bobbins including portions interconnecting the bobbins and spindle assemblies.

When the doffing operation for changing completed yarn packages to empty bobbins is automatically conducted by using auto-doffers in textile spinning machines, twisters or the like, it is necessary to securely fix each tail yarn wrapped several turns on a tail yarn winding portion formed on a base portion of a spindle so as not to move for the purpose of making sure the automatic yarn winding on the bobbin. If it happens that yarn underwindings formed on the tail yarn winding portion move by a slight force, the yarn underwindings are loosened on rising of a ring rail to a position where the yarn is wound on the bobbin, which causes the disordered position of a traveler. Consequently, yarn breakages are liable to occur at the start of the operation.

The greatest cause of hindering the tail yarn from the secure fixing on the tail yarn winding portion is the presence of the yarn underwindings wound on the tail yarn winding portion. Namely, the tail yarn is wrapped several turns on the tail yarn winding portion such as a knurled surface formed on the base portion of the spindle so as not to move. However, an interconnecting yarn formed between the bobbin and the tail yarn winding portion is separated on the subsequent doffing operation, and a new tail yarn is further wrapped several turns on the yarn underwindings remaining on the tail yarn winding portion to repeat the doffing operation. A new tail yarn is wrapped several turns on the yarn underwindings on all such occasions.

When a new tail yarn is further wrapped on the yarn underwindings which are residual tail yarns previously wrapped, the fixing effect of the yarn underwindings by the knurled surface and the like is lost, which permits the yarn underwindings to move by a slight external force, thereby loosening the yarn underwindings.

Previously, in order to eliminate such inconvenience, the yarn underwindings have been periodically manually removed by use of a cutter or the like while the machine is stopped. However, such a prior-art method is reduced in the operation efficiency of the machine, because the operation is complex, labor intensive and time-consuming.

Then, for the purpose of solving such problems of the prior art to securely fix the tail yarn on the base portion of the spindle and to surely remove the yarn underwindings during the machine operation, the present invention has formerly proposed an apparatus for treating the tail yarn which comprises an upper slit ring fixedly mounted on the base portion of the spindle, a cylindrical member having a lower slit ring at an upper end thereof and a lower portion outwardly expandable by centrifugal force, and a guiding surface fixed on a lower part of the base portion of the spindle, the cylindrical member being axially slidably fitted on the base portion of the spindle beneath the upper split ring and mounted so that a lower end of the expandable portion thereof capably comes into contact with the guiding surface, the upper slit ring and the lower slit ring being pressed together to form a tail yarn gripping means, whereby the expansion of the lower portion of the cylindrical member by centrifugal force causes the cylindrical member to slide axially downward to release a pressed state between the upper slit ring and the lower slit ring (U.S. Pat. No. 4,796,442).

However, in the use of such an apparatus, the lower portion of the cylindrical member gets fatigued by repetition of its expansion and restoration to weaken the restoring force thereof upon standstill of the spindle, which results in an decrease in the pressing force of the lower slit ring to the upper slit ring, whereby it happens that the tail yarn can not be securely fixed to the tail gripping means.

SUMMARY OF THE INVENTION

It is therefore an object of the present invention to provide an apparatus for treating a tail yarn which has a lower portion of a cylindrical member not reduced in restoring force even if used for a long period of time and can maintain the effect of fixing securely the tail yarn (interconnecting yarn) to a tail yarn gripping means.

Another object of the invention is to provide the apparatus for treating the tail yarn which can easily remove yarn underwindings, when the yarn underwindings are not released from the tail yarn gripping means under adjustment in the case that the apparatus for treating the tail yarn is newly installed and can improve the effect of fixing securely the tail yarn (interconnecting yarn) to the tail yarn gripping means.

According to the present invention, there is provided an apparatus for treating a tail yarn in a textile spindle assembly having an upper slit ring fixedly mounted on a base portion of a spindle, a cylindrical member having a lower slit ring at an upper end thereof and a lower portion outwardly expandable by centrifugal force of the spindle, and a guiding surface fixed on a lower part of said base portion of the spindle, said cylindrical member being axially slidably fitted on said base portion of the spindle beneath said upper slit ring and mounted so that a lower end of the expandable portion thereof capably come into contact with said guiding surface, said upper slit ring and said lower slit ring being pressed together to form a tail yarn gripping means, whereby expansion of said lower portion of said cylindrical member by centrifugal force causes said cylindrical member to slide axially downward to release a pressed state between said upper slit ring and said lower slit ring, characterized by further comprising a spring member for positively restoring said lower portion of said cylindrical member from an expanded state to an initial state upon standstill of the spindle, said lower portion of said cylindrical member being split by a plurality of slits.

As this spring member, there may be used a ring-like spring fitted around a periphery of the lower portion of the cylindrical member or a leaf spring attached to the lower portion of the cylindrical member. In order to make it easy to remove the yarn underwindings and improve the effect of fixing the tail yarn (interconnecting yarn) to the tail yarn gripping means, a predetermined number of grooves may be radially outwardly formed on an upper surface of this lower slit ring.

DESCRIPTION OF THE PREFERRED EMBODIMENTS

Apparatus of the present invention will hereinafter be described according to the drawings.

Figure 1:
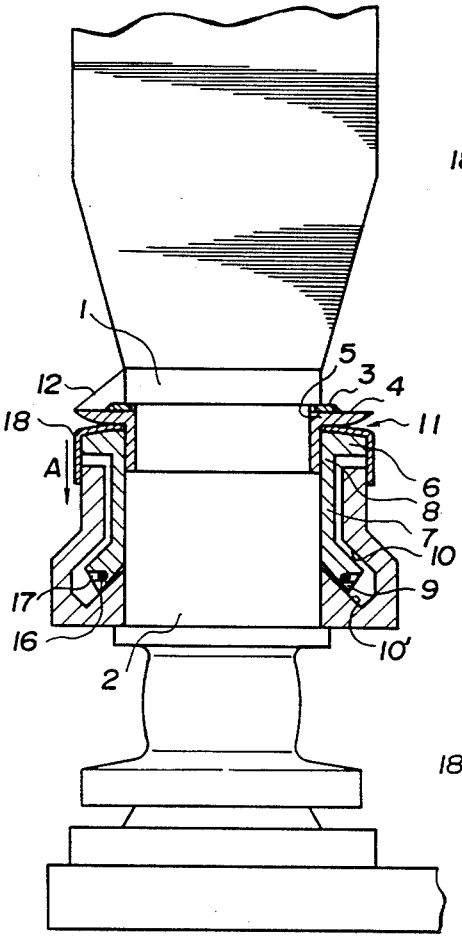
FIG. 1 is a sectional side view showing an embodiment of the present invention.

FIG. 1 is a sectional side view showing an embodiment of the present invention. A cutter holder 4 provided with a cutter 3 is securely fixed on an upper part of a base portion of a spindle 2 on which a bobbin 1 is mounted. In this embodiment, the cutter holder 4 is used as an upper slit ring 5. However, a separate upper slit ring 5 may be securely fixed under the cutter holder 4. A cylindrical member 8 having a lower slit ring 6 at an upper end thereof and a lower portion 7 outwardly expandable by centrifugal force is axially slidably fitted on the base portion 2 of the spindle beneath the upper slit ring 5 (cutter holder 4).

The cylindrical member 8 is mounted so that a lower end 9 of the expandable portion (lower portion) 7 thereof capably comes into contact with a guiding surface 10' fixed on the base portion 2 of the spindle. The upper slit ring 5 (cutter holder 4) and the lower slit ring 6 are pressed together to form a tail yarn gripping means 11. When the spindle rotates and the lower portion 7 of the cylindrical member 8 is outwardly expanded by the centrifugal force of the spindle, the lower end 9 comes into contact with the stationary guiding surface 10, which causes the cylindrical member 8 to slide axially downward (in the direction shown by arrow A) to release a pressed state between the upper slit ring 5 and the lower slit ring 6. The mark Y designates a yarn to be wound on the bobbin 1, the numeral 12 designates an interconnecting yarn formed between the tail yarn gripping means 11 and the bobbin 1, the numeral 12' designates a tail yarn corresponding to the interconnecting yarn 12 after separated (see FIGS. 7 and 8), the numeral 16 designates a ring-like coil spring fitted in a groove 17 formed around a periphery of the lower end 9 of the lower portion 7 of the cylindrical member 8, and the numeral 18 designates a cover.

Figure 2:
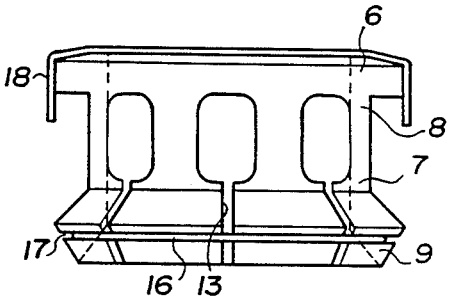
FIGS. 2 and 3 are side views showing cylindrical members which may be used in the present invention.
Figure 3:
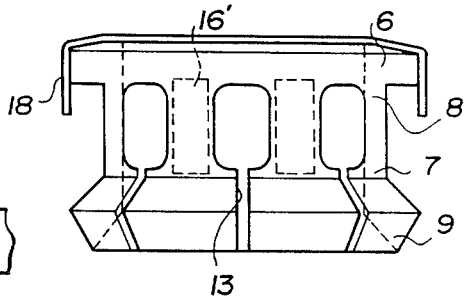

As shown in FIGS. 2 and 3, the upper end of the cylindrical member 8 constitutes the lower slit ring 6 and the lower portion 7 thereof is split by a plurality of slits 13 so as to be outwardly expanded by centrifugal force. The lower end 9 of the lower portion 7 is not limited to a polygonal shape as shown in FIGS. 2 and 3, but may have any shape such as a circular or a elliptic shape.

The cylindrical member 8 may be composed of any material such as metal or plastic, as long as the lower portion 7 and the lower end 9 thereof are outwardly expandable by centrifugal force.

The groove 17 is formed around the periphery of the lower end 9 of the lower portion 7 of the cylindrical member 8, and the ring-like coil spring 16 is fitted in the groove 17 so that the lower portion 7 of the cylindrical member 8 and the lower end 9 thereof are positively restored from an expanded state to an initial state upon standstill of the spindle (see FIG. 2). In place of the ring-like coil spring, a leaf spring 16' may be embedded in or stuck on the lower portion 7 of the cylindrical member 8 as shown in FIG. 3. Any type and any shape of spring may be used, as long as the lower portion 7 of the cylindrical member 8 and the lower end 9 thereof can be positively restored from the expanded state to the initial state when the spindle is stopped and thereby centrifugal force comes not to be exerted.

By suitable selection of the force of the springs 16 and 16', the material of the cylindrical member 8, the thickness of the lower portion 7, the number and the shape of the slits 13 and the like, the cylindrical member 8 can be slided downward at a desired spindle revolution, and thereby the pressed state between the upper slit ring 5 and the lower slit ring 6 can be released.

The cover 18 is provided for the purpose of preventing floating cottony substances from entering the stationary guide during operation, when the cylindrical member 8 is lowered by the rotational centrifugal force of the spindle and the yarn underwindings are released and removed from the tail yarn gripping means, which cover may be formed integrally with the lower slit ring 6.

One of peripheral end portions of both the slit rings 5 and 6 may be flat, instead of the expanded form shown in the drawings.

Then, the operation of the apparatus of the present invention, when the apparatus shown in FIG. 1 is used, will hereinafter be described in accordance with FIGS. 4 to 8.

In FIGS. 4 to 8, the same parts as in FIG. 1 are designated by the same numerals as in FIG. 1, and the descriptions thereof are omitted.

Figure 4:
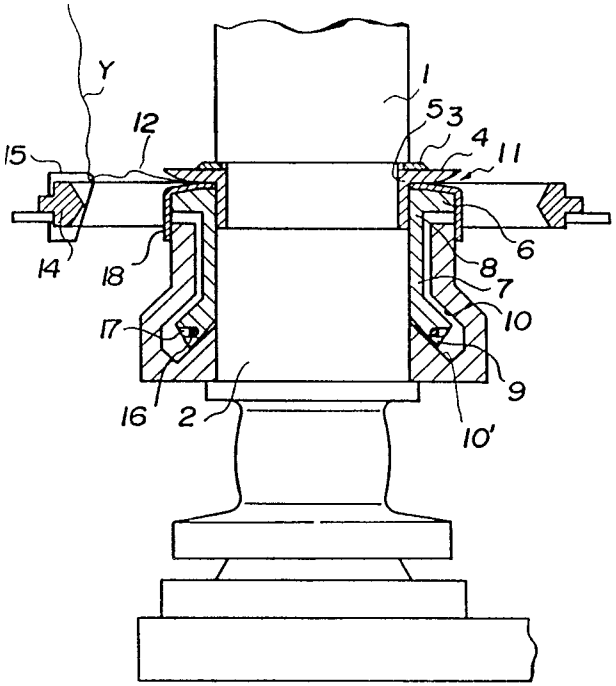

FIG. 4 shows a state just before the start of winding on the bobbin 1 in the textile spindle assembly of the spinning machine, wherein the cylindrical member 8 is pressed upward and the lower slit ring 6 is pressed to the upper slit ring 5 to form the tail yarn gripping means 11.

A yarn Y fed from the roller part (not shown in the drawings) of the spinning machine is passed through the traveler 15 fitted on the traverse ring 14 and held to the tail yarn gripping means 11 by wrapping its end about half to one turn thereon.

Figure 5:
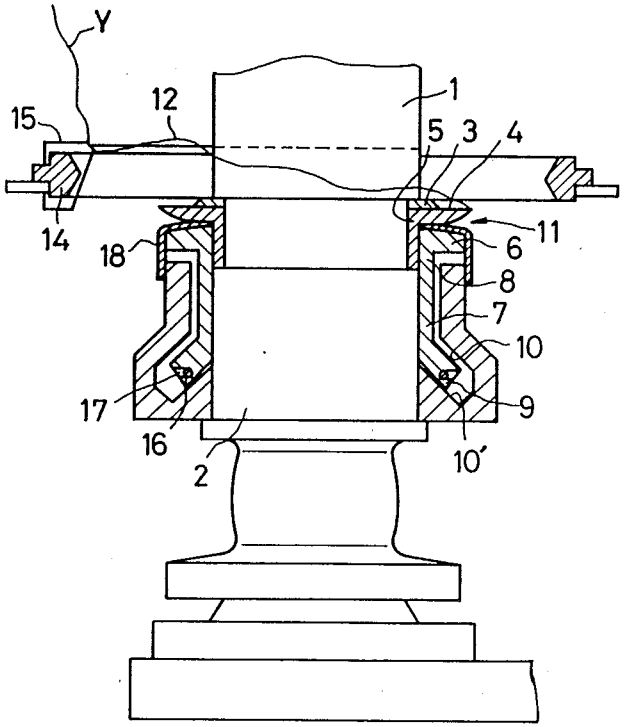
FIGS. 4 to 8 are side views, partly in cross sections, for illustrating operation of an apparatus of the present invention.
Figure 6:
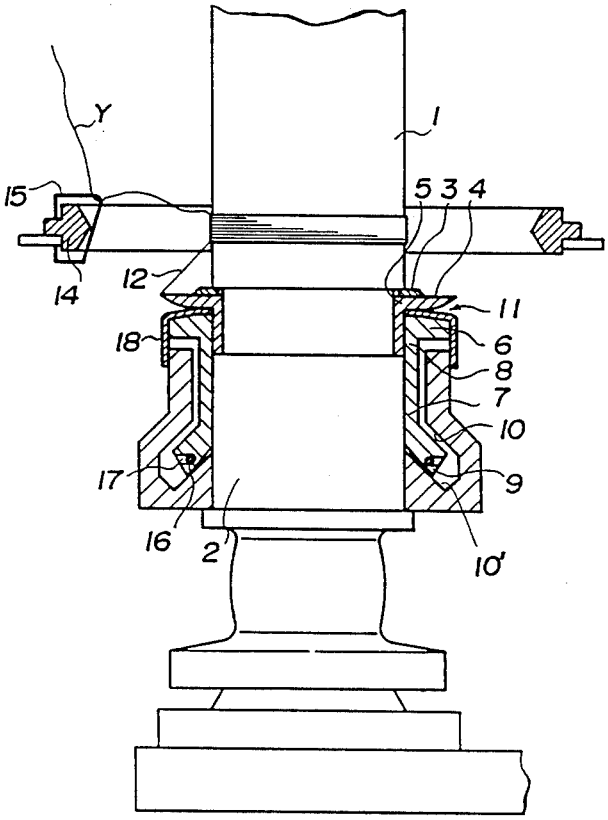
Figure 7:
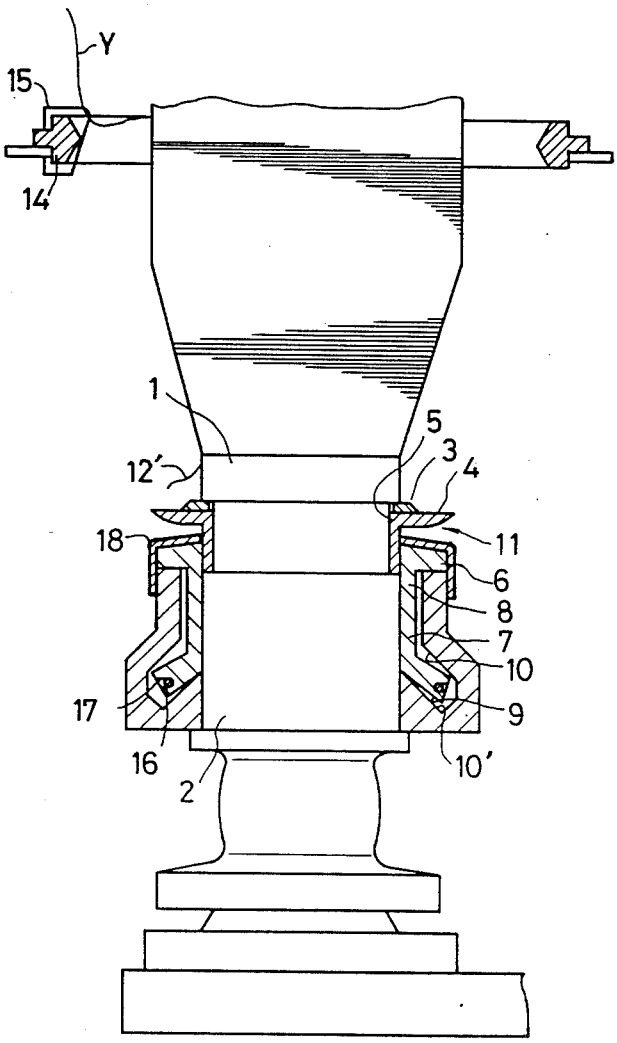

Then, on the start of winding, the traverse ring 14 is raised to the winding position of the bobbin 1 as shown in FIG. 5, and the interconnecting yarn is formed between the tail yarn gripping means and the bobbin 1. The ring rail 15 and the traverse ring 14 reciprocate within the yarn winding range of the bobbin 1 to start the winding of the yarn Y on the bobbin 1 as shown in FIG. 6. Subsequently, when the rotation of the spindle 2 is increased to a predetermined rotation speed, the lower portion 7 of the cylindrical member 8 is outwardly expanded by centrifugal force, as shown in FIG. 7, as a result, the lower end 9 comes into contact with the stationary guiding surface 10.

Thereupon, the movement of the lower end 9 is restricted by the stationary guiding surface 10. Hence, further addition of centrifugal force lowers the cylindrical member 8 automatically downward (in the direction of the arrow A). Thus, the interconnecting yarn 12 which has been held with the tail yarn gripping means 11 is released for removal from the tail yarn gripping means 11 by the rotational centrifugal force of the spindle 2 to form the tail yarn 12'.

In this case, the upper end of the stationary guide closely comes into contact with the lower surface of the lower slit ring 6 inside the cover 18, which covers the stationary guide. It does not therefore happen that floating cottony substances enter the stationary guide.

Figure 8:
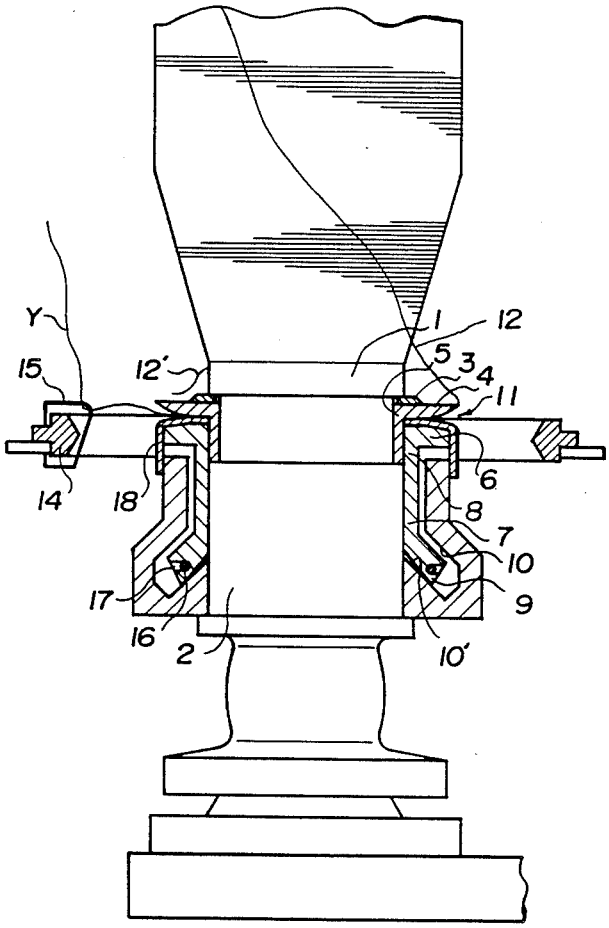

When the yarn package building on the bobbin 1 is completed, the ring rail 15 and the traverse ring 14 are rapidly lowered again to the position corresponding to the tail yarn gripping means 11 as shown in FIG. 8, and the tail yarn is held by wrapping less than 1 turn around the tail yarn gripping means 11. Then, the spindle is stopped. In this case, the previous tail yarn 12' has been completely released for removal from the tail yarn gripping means 11, and the lower portion 7 of the cylindrical member 8 has positively returned from the expanded state to the initial state by the force of the spring 16, with a decrease in rotation speed of the spindle 2. Consequently, the lower end 9 has come into contact with the lower stationary guiding surface 10' to press the cylindrical member 8 upward, and thereby the tail yarn gripping means 11 has returned to the pressed state. Hence, the end of the yarn Y which has been completely wound is very firmly held with the tail yarn gripping means 11.

After the rotation of the spindle is terminated, the completed yarn package is pulled up with an auto-doffer.

At that moment, the interconnecting yarn 12 of the yarn Y formed when the traverse ring 14 lowered to the position corresponding to the tail yarn gripping means 11 is pressed onto the cutter 3 in its stretched condition to separate the interconnecting yarn 12. By repetition of the procedures described above, the doffing operation can be automatically achieved.

When a textile spinning machine, a twister or the like provided with the tail yarn treating apparatus of the present invention is newly installed, or when the base portions of the spindles in a prior-art textile spinning machine, a prior-art twister or the like are changed to the tail yarn treating apparatus of the present invention, the wrapping number of the tail yarn around the tail yarn gripping means 11 is gradually adjusted to less than 1 turn so that the yarn underwindings (not shown in the drawings) which are the residual yarns of the previous separated tail yarn 12' remaining in the tail yarn gripping means 11 are automatically released, prior to the production operation.

Figure 9:
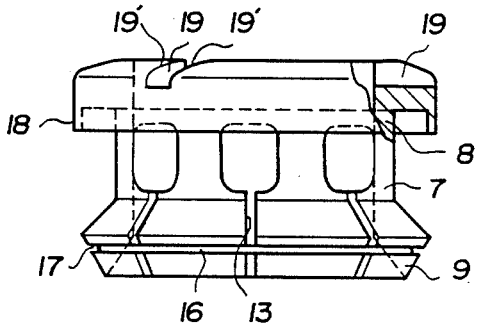
FIG. 9 is a side view, partly in cross section, showing another cylindrical member which may be used in the present invention.
Figure 10:
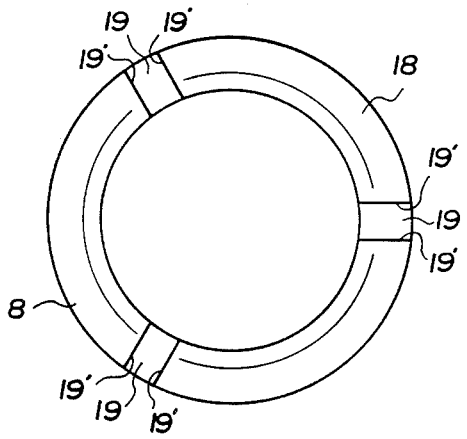
FIG. 10 is a plan view showing another embodiment of the cylindrical member shown in FIG. 9.

In this stage, if the grooves 19 are radially outwardly formed on the upper surface of the lower slit ring 6 as shown in FIGS. 9 and 10, the yarn underwindings not released from the tail yarn gripping means 11 can be removed by sliding a hook-like tool having a hook-shaped tip (not shown in the drawings) along the grooves 19 radially formed.

Moreover, the tail yarn of the yarn Y is engaged with upper edge portions 19' of the grooves 19 radially formed, and therefore the effect of fixing the tail yarn to the tail yarn gripping means 11 is further improved.

Further, any number of grooves 19 radially formed may be used without limitation, though 3 grooves are formed in this embodiment. Usually, 2 to 6 grooves are suitable.

In FIGS. 9 and 10, the lower slit ring 6 and the cover 18 are formed as an integral body.

According to the present invention, the lower portion of the cylindrical member is not reduced in restoring force from the expanded state even if used for a long period of time and can be positively restored from the expanded state to the initial state. Further, the tail yarn can be securely held and the doffing operation can be automatically carried out without failure.

A predetermined number of grooves radially outwardly formed on the upper surface of the lower slit ring make the removal of the yarn underwindings easy and can improve the effect of fixing the tail yarn to the tail yarn gripping means.

I claim:

1. An apparatus for treating a tail yarn in a textile spindle assembly having a spindle with a base portion, said apparatus comprising:

an upper slit ring fixedly mounted on the base portion of the spindle, a cylindrical member having a lower slit ring at an upper end thereof and a lower portion outwardly expandable by centrifugal force, and a guiding surface fixed on a lower part of said base portion of the spindle, said cylindrical member being axially slidably mounted on said base portion of the spindle beneath said upper slit ring such that a lower end of the expandable lower portion thereof is in contact with said guiding surface, said upper slit ring and said lower slit ring being pressed together to form a tail yarn gripping means, said lower portion of said cylindrical member being expandable in the presence of a centrifugal force to cause said cylindrical member to slide axially downward to release a pressed state between said upper slit ring and said lower slit ring, spring means for positively restoring said lower portion of said cylindrical member from an expanded state to an initial state upon standstill of the spindle, and said lower portion of said cylindrical member being split by a plurality of slits.

2. The apparatus according to claim 1, wherein said spring means includes a ring-like spring fitted around a periphery of the lower portion of said cylindrical member.

3. The apparatus according to claim 1, wherein said spring means includes a leaf spring attached to the lower portion of said cylindrical member.

4. The apparatus according to any one of the preceding claims, wherein a predetermined number of grooves are radially outwardly formed on an upper surface of said lower slit ring.

* * * * *